United States Patent [19]

Wang

[11] 4,133,634

[45] Jan. 9, 1979

[54] STEEL STRIP PREHEATING METHOD

[75] Inventor: Robert Wang, Wissous, France

[73] Assignee: Heurtey Metallurgie, Paris, France

[21] Appl. No.: 812,333

[22] Filed: Jul. 1, 1977

[30] Foreign Application Priority Data

Jul. 5, 1976 [FR] France ..... 76 20346

[51] Int. Cl.[2] ..... F27D 7/06; F27D 23/02

[52] U.S. Cl. ..... 432/2; 432/8

[58] Field of Search ..... 432/2, 8; 431/163

[56] References Cited

U.S. PATENT DOCUMENTS

| | | | |
|---|---|---|---|
| 339,219 | 4/1886 | Scott | 432/8 |
| 343,010 | 6/1886 | Clifton | 432/8 |
| 570,450 | 11/1896 | Bradley | 431/163 |
| 2,446,511 | 8/1948 | Kerry et al. | 431/163 |
| 3,971,847 | 7/1976 | Houseman | 431/163 |

*Primary Examiner*—John J. Camby

*Attorney, Agent, or Firm*—Wenderoth, Lind & Ponack

[57] ABSTRACT

Steel strips, notably in a galvanizing unit production line, are preheated in an oven heated with liquid fuel, the latter being mixed with water to form an emulsion, in the proportion of 0.3 to 1 kg of water per kg of liquid fuel, the oven temperature ranging from about 900° to about 1,500° C.

3 Claims, 2 Drawing Figures

STEEL STRIP PREHEATING METHOD

Figures 1, 2:
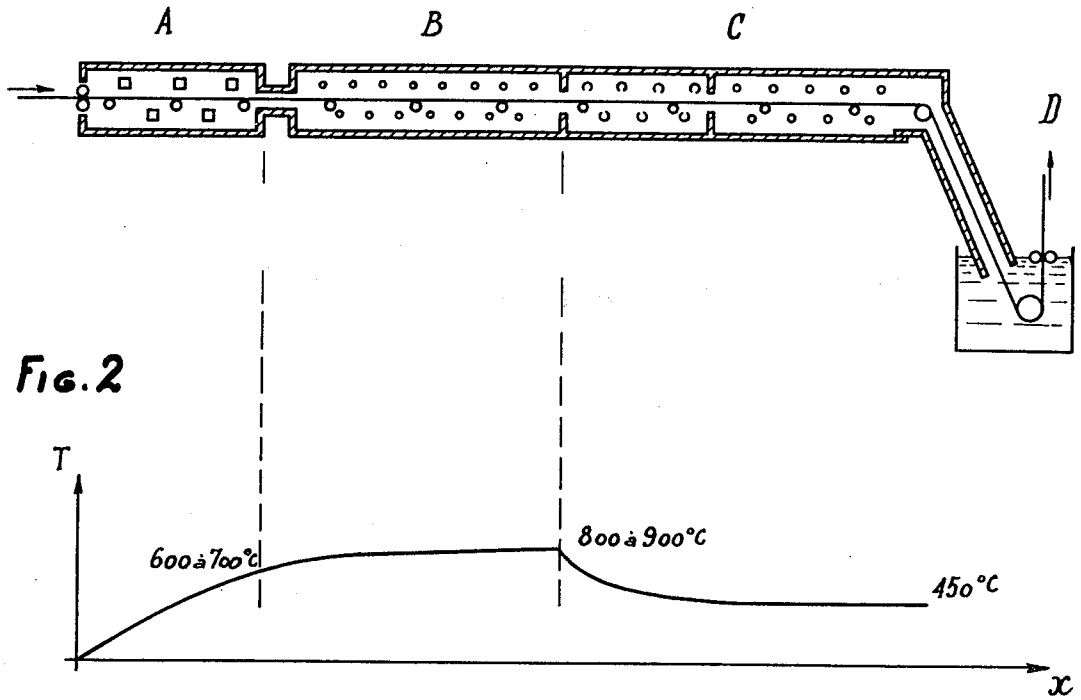

The present invention relates to a method of preheating steel strips, this method being applicable inter alia to non-oxidizing ovens utilized on galvanizing production lines.

It is known that in the manufacture of steel sheets the steel strips are galvanized on high-production lines (FIG. 1) in which the steel strip is firstly cleaned in a preheating oven A, this preheating step taking place from room temperature to a temperature of 600° to 700° C, whereafter the clean steel strip is delivered to a laboratory B where it is still heated under atmosphere up to a temperature of the order of 800° to 900° C, the strip being subsequently cooled in another compartment C to about 450° C before being quenched in a molten zinc bath D. Finally, the strip is dried and cooled.

FIG. 2 of the attached drawing illustrates the temperature diagram of the steel strip during its passage through the successive processing compartments A, B and C.

The function of the preheating oven A is to remove any rolling-mill oil from the steel surface by heating the strip to a temperature within the range of about 400° C in the case of oxidizing ovens and to about 700° C in the case of non-oxidizing ovens as generally employed on modern galvanizing production lines, with due consideration for the fact that they afford high production rates.

All hitherto known non-oxidizing ovens are gas-heated, as a rule with natural gas, and operate with an incomplete gas combustion. In fact, only gaseous fuels are suited for obtaining a sub-stoichiometric combustion with a variable proportion of the order of 2 to 8% of unburnt products without leaving the least trace of soot (i.e. carbon) in the smoke.

This last requirement is extremely important, for if soot particles contained in the flame were allowed to form a deposit on the travelling steel strip, it would be definitely impossible to obtain a proper adherence of the zinc to the steel surface, whatever the treatment applied to the strip between the preheating oven A and the galvanizing bath D. Therefore, the presence of any soot, even in extremely moderate quantities, must definitely be avoided in the case of steel strip preheating ovens.

For this reason, up to now it has scarcely been possible to use liquid fuels for operating steel strip preheating ovens on galvanizing production lines. In fact, the combustion properties of liquid hydrocarbons are such that large amounts of soot are released in the flame when the fuel combustion approaches the stoichiometric limit, notably when the burners are operated with an insufficient air supply.

It is the essential object of the present invention to provide a method directed to avoid these inconveniences by permitting in the preheating oven of a steel strip galvanizing production line the combustion of liquid hydrocarbons with a considerable air deficiency and without the presence of soot or carbon in the flame.

In view of the foregoing, the present invention is directed to provide a method of preheating steel strips in an oven heated with liquid fuel, this method being characterized in that an emulsion of liquid fuel and water is utilized in the oven.

For carrying out the above-defined method, conventional burners equipped with liquid fuel injection means capable of forming an emulsion with water are used.

The mechanism for producing the flame of a carbon-free liquid fuel by the addition of water consists in shifting the hydrocarbon dissociation reaction equilibrium in the presence of water vapor towards the specific methane combustion characteristics. In fact, the C/H ratio of liquid hydrocarbon is much higher than that of methane, and consequently a lower water-vapor content is obtained in the smoke. By forming a liquid fuel and water emulsion it is possible to increase the water vapor content of smoke and to assimilate the combustion of liquid hydrocarbons to that of gas.

The present inventor found that to obtain the desired combustion conditions the preheating oven should operate with an addition of 0.3 to 1 kilogram of water per kilogram of liquid fuel. With this range of water and fuel mixture a clean soot-free combustion is obtained, with only 2 to 8% of unburnt products in the smoke.

According to another feature characterizing this invention, the temperature in the preheating oven may vary from 900° to 1,500° C, and the smoke water-vapor contents resulting from the combustion of the water and fuel emulsion according to the method of this invention ranges from 14 to 19%, these values comparing with those obtained with a current natural gas (18.7%).

In the specific case of the application of the method of this invention to a preheating oven on a galvanizing production line, the rolling-mill oil film can be removed by providing a steel strip dwell time in excess of about 5 seconds in the preheating oven, and in the heat-treatment phase a dwell time of only 20 seconds will be sufficient, at a temperature above 700° C in an atmosphere containing 10% hydrogen, the cycle being completed by a cooling phase.

The method of this invention is perfectly suited for properly preparing the surface of steel strips preliminary to a high-quality galvanization. However, this invention should not be construed as being strictly limited by this specific application, since it can be implemented with other types of ovens and furnaces, notably non-oxidizing ovens for the treatment of silicon steel sheets, and also for preparing the surface of steel sheets in continuous aluminizing ovens or furnaces.

What I claim is:

1. In a process for galvanizing steel strips in a galvanizing production line, said process including the step of preheating said steel strips to clean said steel strips, the improvement wherein said preheating step comprises:

introducing said steel strips into a non-oxidizing oven; and heating said oven, and thereby said steel strips, by burning a liquid emulsion of liquid fuel and water within said oven such that the temperature of the atmosphere within said oven is from 900° C. to 1500° C.

2. The improvement claimed in claim 1, wherein said emulsion includes from 0.3 to 1.0 kilogram of water per kilogram of liquid fuel.

3. The improvement claimed in claim 1, wherein said emulsion is burned within said oven by means of injection burners.

* * * * *